US010604813B2

(12) United States Patent
Gabagnou et al.

(10) Patent No.: US 10,604,813 B2
(45) Date of Patent: Mar. 31, 2020

(54) TANNING COMPOSITION AND METHOD BASED ON AN ACETAL OF AN ALDEHYDIC TANNING AGENT

(71) Applicant: TFL Ledertechnik GmbH, Rheinfelden (DE)

(72) Inventors: Catherine Gabagnou, Mulhouse (FR); Nina Schulte, Freiburg (DE); Grigore Daniel Herta, Rheinfelden (CH); Jens Fennen, Grenzach-Wyhlen (DE)

(73) Assignee: TFL Ledertechnik GmbH, Rheinfelden (DE)

( * ) Notice: Subject to any disclaimer, the term of this patent is extended or adjusted under 35 U.S.C. 154(b) by 0 days.

(21) Appl. No.: 16/089,523

(22) PCT Filed: Mar. 29, 2017

(86) PCT No.: PCT/EP2017/000381

§ 371 (c)(1),
(2) Date: Sep. 28, 2018

(87) PCT Pub. No.: WO2017/174181

PCT Pub. Date: Oct. 12, 2017

(65) Prior Publication Data

US 2019/0106758 A1 Apr. 11, 2019

(30) Foreign Application Priority Data

Apr. 6, 2016 (DE) ..... 10 2016 004 192

(51) Int. Cl.
*C14C 3/00* (2006.01)
*C14C 3/16* (2006.01)

(52) U.S. Cl.
CPC ..... *C14C 3/16* (2013.01)

(58) Field of Classification Search
CPC ..... C14C 3/16; C14C 3/02
See application file for complete search history.

(56) References Cited

U.S. PATENT DOCUMENTS

| | | | | |
|---|---|---|---|---|
| 2,885,443 | A | 5/1959 | Kress et al. | |
| 2,941,859 | A | 6/1960 | Fein et al. | |
| 3,909,193 | A * | 9/1975 | Erdmann | C14C 3/08 8/94.33 |
| 4,448,977 | A | 5/1984 | Warner et al. | |
| 5,011,499 | A | 4/1991 | Rathfelder et al. | |

FOREIGN PATENT DOCUMENTS

| | | |
|---|---|---|
| DE | 2227598 | 1/1974 |
| DE | 3811267 | 5/1989 |

OTHER PUBLICATIONS

STIC Search Report dated Aug. 2, 2019.*

* cited by examiner

*Primary Examiner* — Eisa B Elhilo
(74) *Attorney, Agent, or Firm* — Volpe and Koenig, P.C.

(57) ABSTRACT

A composition including an acetal of an aldehydic tanning agent for tanning hides and/or pelts, as well as a method for tanning hides and/or pelts in order to produce leather, wherein an acetal of an aldehydic tanning agent is used. By reducing the pH, the aldehydic tanning agent can be released, whereby a tanning step is initiated. The composition and the method are characterized by lower toxicity compared to conventional compositions and tanning methods based on aldehydic tanning agents. Furthermore, improved penetration of the tanning agents into deeper layers of the hide and/or the pelt is possible, so that particularly homogeneous tanning is achieved.

24 Claims, No Drawings

TANNING COMPOSITION AND METHOD BASED ON AN ACETAL OF AN ALDEHYDIC TANNING AGENT

BACKGROUND

The invention relates to a composition comprising a tanning agent for tanning hides and/or pelts. Furthermore, the invention also relates to a method for tanning hides and/or pelts in order to produce leather. More particularly, the invention relates to a composition and a method for pretanning and/or retanning, preferably for pretanning.

Numerous compositions and methods of the above-mentioned type are already known. Tanning, and in particular pretanning, of hides and/or pelts using aldehydic tanning agents is generally known and is used commercially for example in the so-called "wet white" method. The aldehydic tanning agents primarily used in this case are formaldehyde, propionaldehyde, glyoxal, and most frequently, glutaraldehyde.

A significant drawback of these known compositions and methods based on use of the above-mentioned tanning agents, however, is that the tanning agents exhibit excessively high reactivity with the proteins of the hide to be tanned. Frequently, therefore, in particular in the case of relatively thick hides and/or pelts, the penetration of the tanning agents into deeper layers of the hide to be tanned and/or the pelt to be tanned is insufficient. This can lead to uneven tanning, which can negatively affect the quality of the leather produced.

A further drawback of known compositions and methods of the above type that are based on the use of these tanning agents is that aldehydic tanning agents generally have extremely high toxicity and a pungent odor. However, it is often impossible with known compositions and the methods based thereon to avoid breathing aldehydic vapors and coming into direct contact with these aldehydic tanning agents, thus exposing persons who use these agents for tanning hides and/or pelts to an increased health hazard. In this connection, there is therefore a need to improve occupational safety in tanning with aldehydic tanning agents.

SUMMARY

The object is therefore to provide a composition and/or a method of the above-mentioned type in which the above-mentioned drawbacks do not occur.

In order to achieve the above-mentioned object according to the invention, a composition is therefore proposed that is intended for tanning hides and/or pelts, comprising:

5 wt % to 100 wt % of an acetal of an aldehydic tanning agent, 0 wt % to 5 wt % of a pH-regulating buffer component, and 0 wt % to 90 wt % of a solvent, or comprising:

5 wt % to 95 wt %, in particular 5 wt % to 50 wt %, of an acetal of an aldehydic tanning agent, 0.01 wt %, in particular 1 wt %, to 5 wt % of a pH-regulating buffer component, and 4 wt % to 90 wt % of a solvent.

The composition according to the invention has the advantage compared to known compositions based on aldehydic tanning agents that acetals of aldehydic tanning agents are virtually or completely unreactive with the proteins of the hide and/or pelts to be tanned. Such acetals are stable in a neutral and alkaline medium in particular and therefore do not react with the above-mentioned proteins if the composition according to the invention is applied at this pH to the hide and/or the pelt. In addition, acetals of aldehydic tanning agents show lower toxicity than the aldehydic tanning agent itself, i.e. the aldehyde. A further surprising effect that is completely unknown to date is shown by the composition according to the invention in that when the composition according to the invention is used for tanning, one can achieve improved penetration into deeper layers of the hide to be tanned and/or the pelt to be tanned. More particularly, in relatively thick hides and pelts, this makes it possible to achieve more homogeneous tanning compared to known compositions based on aldehydic tanning agents. When the composition according to the invention has been applied to a hide to be tanned and/or a pelt, after a certain exposure time, the pH can be reduced so that the aldehydic tanning agent is released and thus becomes reactive. When the acetal acts on the hide and/or the pelt, this therefore allows it to penetrate into deeper layers and allows the tanning agent to then be released in these areas. After tanning has been carried out, by increasing the pH, the aldehydic tanning agent can be fixed and the tanning terminated. Furthermore, the composition according to the invention is applied in non-reactive form to a hide and/or a pelt, which can be provided for example in a sealable vessel. By means of subsequent acidification, i.e. reduction of the pH, the aldehydic tanning agent of the composition can be activated, wherein this can be carried out for example inside of the sealed vessel by adding an acid. In this manner, one can better prevent a user from inhaling aldehyde vapors and coming into contact with the composition, whereby occupational safety in tanning can be significantly increased. Alternatively or additionally, the composition according to the invention can also be used on a bated, stripped, untanned pelt.

According to a preferred improvement of the composition according to the invention, the acetal of an aldehydic tanning agent is an acetal of formaldehyde, propionaldehyde, glutaraldehyde and/or glyoxal. More particularly, it can be provided that the composition comprises two or more of the above-mentioned acetals. According to a preferred embodiment, the acetal is an acetal of glutaraldehyde. The above-mentioned acetals of aldehydic tanning agents show a particularly favorable tanning action.

It may further be preferable if an alcohol component of the acetal of an aldehydic tanning agent is methanol, ethanol, diethylene glycol and/or triethylene glycol. Preferably, the alcohol component of the acetal is methanol. Methods for producing acetals of an aldehydic tanning agent are already known from the prior art. For example, U.S. Pat. Nos. 2,885,443 and 4,448,977 describe methods for producing an acetal, in particular of glutaraldehyde. The acetal of an aldehydic tanning agent produced by known methods can also be purified using further known purification methods, such as e.g. by column chromatography, in particular flash chromatography, in order to obtain even purer acetal.

In order to allow the reactivity of an aldehydic tanning agent released by reduction of the pH during a tanning step to be further reduced, it can be advantageous if the composition according to the invention comprises at least one saccharide, in particular a reducing saccharide. Alternatively or additionally, it can be advantageous if the composition according to the invention comprises at least one saccharide with a dextrose equivalent of 10 to 100. According to a preferred embodiment of the composition according to the invention, it can be provided that the content of the at least one saccharide in the composition is 0.1 wt % to 30 wt %, in particular 2.5 wt % to 15 wt %. This allows the reactivity of the released aldehydic tanning agent to be further reduced, thus allowing slower and gentler tanning to be achieved due to improved penetration (also during the actual tanning) into deeper hide layers.

In this connection, it can be particularly advantageous if the composition has at least one or the at least one above-mentioned saccharide, which is selected from the group of glucose, sucrose or a mixture of glucose and sucrose. These are reducing saccharides particularly well-suited for tanning that lead to improved tanning of a hide and/or a pelt.

According to an advantageous improvement of the composition according to the invention, it can be preferable for the composition to have a polyoxyalkylene glycol component. More particularly, it can be provided according to the invention that the polyoxyalkylene glycol component is selected from the group of polyoxyethylene diol, polyoxy-1,2-propylene diol, and a mixture of polyoxyethylene diol and polyoxy-1,2-propylene. More particularly, it can be provided that the composition comprises two or more of the above-mentioned polyoxyalkylene glycols.

In order to further improve the leather quality, it can be further be particularly advantageous if a content or the above-mentioned content of polyoxyalkylene glycol in the composition includes one or a plurality of polyoxyalkylene glycols with a molecular weight $M_R$ of 120 to 1,000. In this context, it can be particularly advantageous if a content or the above-mentioned content of polyoxyalkylene glycol(s) in the composition is 2.5 to 15 wt %.

According to a preferred embodiment of the composition according to the invention and/or the method according to the invention, as also described and claimed herein, it can be provided that the acetal of an aldehydic tanning agent is an acetal according to formula A and/or formula B, wherein:

Formula A is:

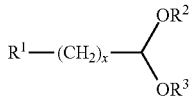

and

Formula B is:

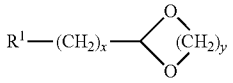

wherein x=0 to 8, y=2 to 6, $R^1$=—H, —$CH_2$, —CHO,

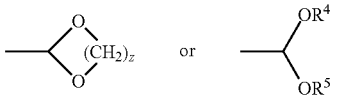

and wherein z=2 to 6 and $R^2$, $R^3$, $R^4$ and $R^5$, each independently of one another, is/are selected from

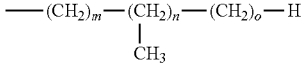

and wherein m=0 to 8, n=0 to 8, o=0 to 8.

The acetals according to formulae A and B yield a particularly favorable result in the production of leather.

It may further be preferable if the composition according to the invention additionally contains an aldehyde, in particular wherein the content of the aldehyde in the composition is 0.1 wt % to 50 wt %, in particular 5 wt % to 50 wt %, in particular 10 wt % to 40 wt %, in particular 20 wt % to 30 wt %.

The solvent of the composition according to the invention can be selected from the group composed of water, water-soluble organic solvents or a mixture of water and water-soluble organic solvents. Examples of suitable water-soluble organic solvents include glycerol and/or a monoetherified polyoxyalkylene glycol. Alternatively or additionally, it can also be provided that the water-soluble organic solvent has a molecular weight $M_R$ greater than or equal to 100 and/or less than or equal to 2,000.

According to a further preferred embodiment of the composition according to the invention, the pH-regulating buffer component can be used to set a pH of the composition of 7.5 to 10.5. In this pH range, the aldehydic tanning agent is stable and therefore not reactive with the proteins of the hide to be tanned and/or the pelt to be tanned. In this manner, particularly favorable penetration of the composition into deeper layers can be achieved.

Suitable pH-regulating buffer components can for example be one or a plurality selected from the group composed of carbonate buffer, borate buffer and/or phosphate buffer.

Furthermore, in order to solve the above-mentioned object, a method is provided according to the features of the two independent method claims. More particularly, in order to solve the above-mentioned object, a method of the above-mentioned type is proposed, comprising the following steps:

- provision of a hide and/or a pelt in a liquor with a pH of between 1 and 3.5, addition of an acetal of an aldehydic tanning agent on the hide and/or the pelt in the liquor,
- acting of the acetal added in the liquor on the hide and/or the pelt in a tanning step,
- adjustment of the pH of the liquor to between 3.8 and 5 in order to fix the aldehydic tanning agent in a fixing step, or comprising the following steps:

- provision of a hide and/or a pelt in a liquor with a pH of between 1 and 10, in particular 6 to 9, in particular 7.5 to 8.5,
- addition of an acetal of an aldehydic tanning agent on the hide and/or the pelt in the liquor,
- acting of the acetal added in the liquor on the hide and/or the pelt in a penetration step,
- adjustment of the pH of the liquor to between 1 and 3.6 in an activation step, wherein the aldehydic tanning agent is released,
- acting of the aldehydic tanning agent released in the liquor on the hide and/or the pelt in a tanning step,
- adjustment of the pH of the liquor to between 3.8 and 5 in order to fix the aldehydic tanning agent in a fixing step.

Both methods can be supplemented by the further advantageous embodiments described below.

For the method according to the invention, as described and claimed herein, the same advantages apply as those discussed above for the composition according to the invention. Furthermore, the method according to the invention, as well as the composition according to the invention, can be used for tanning, pretanning and/or retanning of a stripped, untanned pelt. The term stripped, untanned pelt can be defined as a pelt with the meat and/or hair removed after pickling and/or bating, but which has not yet been tanned.

According to a preferred embodiment of the method according to the invention, an acetal of an aldehydic tanning agent, an acetal of formaldehyde, propionaldehyde, glutaraldehyde, glyoxal and/or an acetal according to formula A and/or formula B can be used. More particularly, it can be advantageous if two or more of the above-mentioned acetals are used. It can be particularly advantageous if at least one acetal of glutaraldehyde is used.

In this context, it can be advantageous if an aqueous liquor is used as the liquor.

Particularly favorable tanning can be achieved by using methanol, ethanol, diethylene glycol and/or triethylene glycol or two or more of the above-mentioned alcohol components as an alcohol component of the acetal. According to a particularly advantageous embodiment of the method according to the invention, methanol can be provided as an alcohol component.

It can be particularly advantageous if, in the method according to the invention, the acetal is added with a composition comprising further components. Alternatively or additionally, it can be particularly advantageous if the acetal is added with the composition according to the invention, as described and claimed herein.

A particularly favorable tanning action can be achieved if a content of the added acetal based on a total weight of the pelt and/or the hide is 0.25 wt % to 10 wt %, in particular 1.0 wt % to 6.0 wt %, in particular 1.5 wt % to 5 wt %, preferably 2.0 wt % or 4.5 wt %.

In the method according to the invention, it can be particularly advantageous if the pH is adjusted to 6 to 9, in particular to 7.5 to 8.5, before adding the acetal. At such a pH, the aldehydic tanning agent is not released, so that the acetal remains stable. For this reason, the aldehydic tanning agent cannot (yet) react with the proteins of the hide and/or the pelt.

It can be provided according to the invention that the acetal is added after carrying out a bating process and/or a pickling step. During such a pickling step, the hide and/or the pelt can be treated with an acid and/or with sodium chloride. Numerous bating processes and pickling steps are already known from the prior art.

In order to release the aldehydic tanning agent, it can be provided that after addition of the acetal to the liquor, the pH of the liquor is adjusted to 1 to 2.5, in particular 1.8 to 2.5. After release of the aldehydic tanning agent, said agent can react with the proteins of the hide to be tanned and/or the pelt to be tanned.

According to a preferred embodiment of the method according to the invention, it can be advantageous if the temperature of the liquor, at least during the tanning step, i.e. after activation of the aldehydic tanning agent, is between 10° C. and 50° C., in particular between 20° C. and 30°, in particular 25° C. Particularly favorable tanning can be achieved at the above-mentioned temperatures.

Furthermore, it is conceivable that the acetal for tanning is provided in the composition according to the invention and/or the method according to the invention in combination with other tanning agents. Suitable further tanning agents for this purpose are given in the examples below.

Furthermore, the invention also relates to leather produced according to the method of the invention, as described and claimed herein, and/or by use of the composition according to the invention, as described and claimed herein. More particularly, the leather according to the invention can be a pre-tanned leather.

Moreover, the invention also relates to use of the above-mentioned leather according to the invention in order to produce a buffed and/or full-grain crust leather by means of one or a plurality of steps selected from the group of retanning, fatliquoring, filling and/or dyeing.

For this reason, the invention also relates to a crust leather, in particular a buffed and/or full-grain crust leather, produced by treatment of the leather according to the invention as mentioned above, with one or a plurality of the steps selected from the group of retanning, fatliquoring, filling and/or dyeing.

The invention also relates to use of the leather according to the invention, as described and claimed herein, and/or the crust leather according to the invention, as described and claimed herein, for the production of dressed leather, in particular for the production of an automobile, furniture, clothing, glove, leather product, aircraft, lining and/or shoe upper article.

The invention also relates to a composition comprising an acetal of an aldehydic tanning agent for tanning hides and/or pelts, as well as a method for tanning hides and/or pelts in order to produce leather, wherein an acetal of an aldehydic tanning agent is used. By reduction of the pH, the aldehydic tanning agent can be released, whereby a tanning step is initiated. The composition according to the invention and the method according to the invention are characterized by lower toxicity compared to conventional compositions and tanning methods based on aldehydic tanning agents. Furthermore, improved penetration of the tanning agents into deeper layers of the hide and/or the pelt is possible, so that particularly homogeneous tanning is achieved.

DETAILED DESCRIPTION

Examples

As described and claimed herein, acetals of aldehydic tanning agents can be used for pretanning and/or retanning of hides, in particular animal hides, and/or pelts, wherein these can be from an animal from the group of cattle, pigs, goats, roebucks, sheep, and/or deer.

The above-mentioned acetals of aldehydic tanning agents and use thereof, as described and claimed herein, can also be applied in pretanning and/or retanning of hides, in particular animal hides, and/or pelts that are pretreated by means of known conventional methods. In this context, examples of suitable methods for pretreatment include liming, deliming, bating, pickling and/or mechanical treatment.

The method according to the invention for the pretanning, (primary) tanning and/or retanning of hides, in particular animal hides and/or pelts, as described and claimed herein, can be carried out in an aqueous medium, in particular in an aqueous liquor. In this case, the pH can be adjusted to values of 1 to 10.

A suitable temperature for carrying out the method according to the invention can be between 10° C. and 50° C. The temperature is preferably at a level between 15° C. and 35° C., in particular 25° C.

A suitable duration of the actual tanning step, i.e. the incubation time of the hides and/or pelts with the released aldehyde (corresponds to the aldehydic tanning agent) can be from 10 min to up to 12 h.

The method according to the invention, as described and claimed herein, is outstandingly suitable for being carried out in existing tanneries. More particularly, a hide to be tanned and/or a pelt to be tanned can be prepared in a conventional tanning receptacle. All further steps of the method according to the invention can then for example be carried out in this vessel and/or in a drum.

Moreover, in the method according to the invention as described and claimed herein, further tanning agents for pretanning and/or retanning of hides, in particular animal hides and/or pelts, can also be used in combination in addition to the acetal of an aldehyde and/or the aldehydes. Examples of suitable further tanning agents can include mineral tanning agents such as chromium, aluminum, zirconium, titanium, and iron salts, synthetic tanning agents (synthanes), polymeric tanning agents and/or vegetable tanning agents (plant tanning agents).

The indications in wt % in the following specific examples are based on the total weight of the hide to be tanned and/or the pelt to be tanned.

Example 1

The hide to be tanned and/or the pelt to be tanned are prepared in 3000 mL of water (also referred to below as aqueous liquor) with a pH adjusted to 7.5 to 8.5 and a temperature of 25° C. in a suitable vessel.

4.5 wt % of an acetal of an aldehydic tanning agent, for example an acetal of glutaraldehyde, is then added to the aqueous liquor. In this case, the acetal was produced as described in U.S. Pat. No. 2,885,443 and/or U.S. Pat. No. 4,448,977.

In a penetration step, the liquor with the acetal is allowed to act on the hide and/or the pelt, for example in a rotatable drum provided for this purpose. An exposure time can be freely selected, for example depending on the thickness of the hide and/or the pelt. The thicker a hide and/or pelt is, the longer the set exposure time should be in order to achieve sufficient penetration of the acetal into the deeper hide layers. For example, the exposure time can be between 2 h and 7 h. A preferred exposure time in this case is 5 h.

After the penetration step is completed, 2 wt % of formic acid is added and the pH is adjusted to 1.8 to 2.5. The reduction in pH causes the aldehydic tanning agent, for example in the form of glutaraldehyde, to be released. The released aldehydic tanning agent can then react with the proteins of the hide and/or the pelt, in particular with collagen. In this manner, the actual tanning is initiated.

After this, the released aldehyde is allowed to act on the hide and/or the pelt in a tanning step, for example in the rotatable drum. Here, a suitable exposure time can be between 1.5 h and 5 h, preferably 3 h.

After the exposure time of the tanning step has elapsed, 2 wt % of sodium hydrogen carbonate is added. After this, the aqueous liquor is allowed to act on the pretanned hide and/or the pretanned pelt in order to fix the aldehyde as completely as possible. The exposure time can for example be between 1.5 and 4.5 h, in particular 3 h. The pH is then adjusted to 4.0 to 4.2.

After fixation of the pretanned hide and/or the pretanned pelt, the liquor is discarded, and the pretanned hide and/or the pretanned pelt is washed with water, in particular with approx. 3000 mL of water.

After this, the pretanned hide and/or the pretanned pelt can be dried and for example adjusted to a thickness of 1.1 to 1.3 mm.

Example 2 (Reference Example)

The hide to be tanned and/or the pelt to be tanned are prepared in 3000 mL of water (also referred to below as aqueous liquor) with a set pH of 3.0 to 3.2 and a temperature of 25° C. in a suitable vessel. In the method according to example 2, unlike the method according to example 1, no penetration step is provided in which the aldehydic tanning agent in the form of the acetal is first allowed to act on the hide and/or the pelt without reacting with proteins.

2.1 wt % of an acetal of an aldehydic tanning agent, for example an acetal of glutaraldehyde, is then added to the aqueous liquor. The low pH of the liquor causes the aldehyde, for example in the form of glutaraldehyde, to be directly released and allows it to react with the proteins of the hide and/or the pelt. This step therefore corresponds to the actual tanning step. After this, the released aldehyde is allowed to act on the hide and/or the pelt, for example in the rotatable drum. In this case, a suitable exposure time can be between 3 h and 7 h, preferably 5 h.

Results

| | Shavability | Shrinking temperature | Color |
|---|---|---|---|
| Example 1 | 2 | 78 | 2 |
| Example 2 (reference example) | 3 | 76 | 2 |
| GA reference sample | 3 | 75 | 2 |

(key: 1 = very good, 2 = good, 3 = satisfactory, 4 = sufficient)

All three leather samples produced were treated in a rotatable drum together with a mixture of the following components (wt % based on the weight of the leather samples):

100 wt % of water, 28 wt % of the sulfone tanning agent SELLATAN MBS gran, and 12 wt % of the sulfone tanning agent SELLATAN HAT liq., 3 wt % of the resin tanning agent MAGNOPAL DP and 2 wt % each of the fatliquoring components CORIPOL ALF and CORIPOL ESA were added and incubated in the drum. After 3 h, the pH was adjusted to 4.6. 2 wt % of the dye SELLA FAST Orange 2GC was added and incubation was carried out for 8 h. After this, the pH was adjusted to 4.0 by adding formic acid. The liquid was then discarded, and the leather was washed once with 300 wt % of water.

100 wt % of water was heated to a temperature of 45° C., and 4 wt % of CORIPOL ALF and 8 wt % of CORIPOL ESA were added as fatliquoring components.

After an exposure time of 60 min, the pH was set to 3.5 by adding formic acid. After this, the leather was washed twice with 100 wt % of water and stored wet overnight. The leather was then vacuum-dried. After the leather was then stretched, it was evaluated as shown below:

| | GA reference sample | Example 1 | Example 2 (reference example) |
|---|---|---|---|
| Fullness | 0 | 0 | 0 |
| Fullness in the abdominal area | 0 | 0 | 0 |
| Softness | 0 | −0.5 | −0.5 |
| Grain | 0 | 0 | 0 |
| Color of crust | 0 | +0.5 | +0.5 |

-continued

| | GA reference sample | Example 1 | Example 2 (reference example) |
|---|---|---|---|
| Homogeneity | 0 | 0 | 0 |
| Feel | Silky | Silky | Dry |

(key: +2/−2 = significant deviation, +1/−1 = deviation, 0 = no deviation)

The invention claimed is:

1. A composition for tanning hides and/or pelts, comprising:

5 wt % to 95 wt % of an acetal of an aldehydic tanning agent, 1 wt % to 5 wt % of a pH-regulating buffer component, and 4 wt % to 90 wt % of a solvent, at least one saccharide, and a content of the at least one saccharide in the composition is 0.1 wt % to 30 wt %, wherein a pH of the composition is set by the pH-regulating buffer component to 7.5 to 10.5.

2. The composition according to claim 1, wherein the acetal of an aldehydic tanning agent is an acetal of at least one of formaldehyde, propionaldehyde, glutaraldehyde or glyoxal.

3. The composition according to claim 1, wherein the acetal of an aldehydic tanning agent includes an alcohol component, and the alcohol component is at least one of methanol, ethanol, diethylene glycol or triethylene glycol.

4. A composition for tanning hides and/or pelts, comprising:

5 wt % to 95 wt % of an acetal of an aldehydic tanning agent, up to 5 wt % of a pH-regulating buffer component, and up to 90 wt % of a solvent, at least one saccharide, and a content of the at least one saccharide in the composition is 0.1 wt % to 30 wt %, wherein a pH of the composition is set by the pH-regulating buffer component to 7.5 to 10.5, wherein the acetal of an aldehydic tanning agent is an acetal of at least one of formaldehyde, propionaldehyde, glutaraldehyde or glyoxal, and wherein the acetal of an aldehydic tanning agent includes an alcohol component, and the alcohol component is at least one of methanol, ethanol, diethylene glycol or triethylene glycol.

5. The composition according to claim 4, wherein the at least one saccharide is selected from the group consisting of glucose, sucrose or a mixture of glucose and sucrose.

6. A composition for tanning hides and/or pelts, comprising:

5 wt % to 95 wt % of an acetal of an aldehydic tanning agent, 1 wt % to 5 wt % of a pH-regulating buffer component, and 4 wt % to 90 wt % of a solvent, polyoxyalkylene glycol selected from the group consisting of polyoxyethylene diol, polyoxy-1,2-propylene diol or a mixture of polyoxyethylene diol and polyoxy-1,2-propylene diol, wherein a pH of the composition is set by the pH-regulating buffer component to 7.5 to 10.5.

7. The composition according to claim 6, wherein the polyoxyalkylene glycol in the composition includes one or a plurality of polyoxyalkylene glycols with a molecular weight $M_R$ of 120 to 1000, or the polyoxyalkylene glycol(s) in the composition is 2.5 wt % to 15 wt %, or both.

8. The composition according to claim 1, wherein the acetal of an aldehydic tanning agent is an acetal according to at least one of formula A or formula B, wherein:

Formula A is:

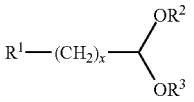

and

Formula B is:

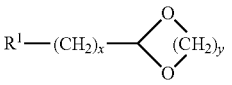

wherein x=0 to 8, y=2 to 6, $R^1$=—H, —CM, —CHO,

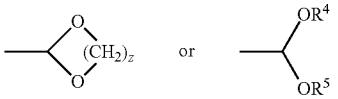

and wherein z=2 to 6 and $R^2$, $R^3$, $R^4$ and $R^5$, each independently of one another, is/are selected from

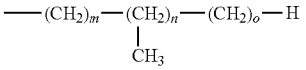

and wherein m=0 to 8, n=0 to 8, and o=0 to 8.

9. The composition according to claim 1, further comprising an aldehyde, and a content of the aldehyde in the composition is 0.1 wt % to 50 wt %.

10. The composition according to claim 1, wherein the solvent is selected from the group consisting of water, water-soluble organic solvents or a mixture of water and water-soluble organic solvents.

11. The composition according to claim 1, wherein the pH-regulating buffer component is one or a plurality selected from the group consisting of carbonate buffer, borate buffer or phosphate buffer.

12. A method for at least one of pretanning or retanning of hides and/or pelts in a liquor, comprising the following steps:

providing a hide and/or a pelt in a liquor with a pH of between 1 and 3.5, adding an acetal of an aldehydic tanning agent on the hide and/or the pelt in the liquor, the acetal added in the liquor acting on the hide and/or the pelt in a tanning step, and adjusting of the pH of the liquor to between 3.8 and 5 in order to fix the aldehydic tanning agent in a fixing step.

13. A method for at least one of pretanning or retanning of hides and/or pelts in a liquor, comprising the following steps:

providing a hide and/or a pelt in a liquor with a pH of between 1 and 10, adjusting the pH to between 6 and 9 before addition of an acetal of an aldehyde tanning agent, adding the acetal of an aldehydic tanning agent on the hide and/or the pelt in the liquor, the acetal added in the liquor acting on the hide and/or the pelt in a penetration step, adjusting the pH of the liquor to between 1 and 3.6 in an activation step, thereby releasing the aldehydic tanning agent, the aldehydic tanning agent released in the liquor acting on the hide and/or the pelt in a tanning step, and adjusting the pH of the liquor to between 3.8 and 5 in order to fix the aldehydic tanning agent in a fixing step.

14. The method according to claim 12, wherein as the acetal of an aldehydic tanning agent, at least one of an acetal of formaldehyde, propionaldehyde, glutaraldehyde, glyoxal or an acetal according to at least one of formula A or formula B is used, wherein:

Formula A is:

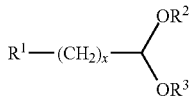

and

Formula B is:

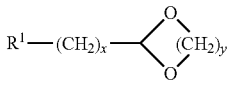

wherein x=0 to 8, v=2 to 6, $R^1$=—H, —$CH_2$, —CHO,

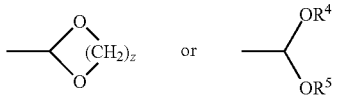

and wherein z=2 to 6 and $R^2$, $R^3$, $R^4$ and $R^5$, each independently of one another, is/are selected from

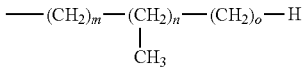

and wherein m=0 to 8, n=0 to 8, and o=0 to 8.

15. The method according to claim 13, wherein at least one of methanol, ethanol, diethylene glycol or triethylene glycol is used as an alcohol component of the acetal.

16. The method according to claim 13, wherein the acetal is added with a composition further comprising at least one of a saccharide, polyoxyalkylene glycol, or an aldehyde.

17. The method according to claim 13, wherein a content of the added acetal based on a total weight of the pelt and/or the hide is 0.25 wt % to 10 wt %.

18. The method according to claim 13, wherein before addition of the acetal, the pH is adjusted to 6 to 9.

19. The method according to claim 13, wherein the acetal is added after carrying out at least one of a bating method or a pickling method on the hide and/or the pelt.

20. The method according to claim 13, wherein after addition of the acetal, the pH of the liquor is adjusted to 1 to 2.5.

21. The method according to claim 13, wherein a temperature of the liquor during tanning is between 10° C. and 50° C.

22. A leather produced by the method according to claim 13.

23. A crust leather, produced by treatment of the leather according to claim 21 by at least one of the steps selected from the group consisting of retanning, fatliquoring, filling or dyeing.

24. A method for the production of dressed leather, comprising tanning the leather according to claim 21.

* * * * *